US006530762B2

(12) United States Patent
Houze et al.

(10) Patent No.: US 6,530,762 B2
(45) Date of Patent: Mar. 11, 2003

(54) VACUUM PUMP COOLING SYSTEM, AND A METHOD OF MAKING IT

(75) Inventors: François Houze, Cuvat (FR); François Besson, Annecy (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/825,336

(22) Filed: Apr. 4, 2001

(65) Prior Publication Data

US 2001/0028858 A1 Oct. 11, 2001

(30) Foreign Application Priority Data

Apr. 6, 2000 (FR) ..... 00 04393

(51) Int. Cl.[7] ..... F01C 21/04

(52) U.S. Cl. ..... 418/83; 418/179; 418/206.1; 29/888.02; 29/419.2; 72/41; 72/56

(58) Field of Search ..... 418/83, 179, 206.1; 29/888.02, 419.2; 72/56, 41

(56) References Cited

U.S. PATENT DOCUMENTS 2,393,283 A * 1/1946 Boyles et al. ..... 9/890.044
3,642,522 A * 2/1972 Gass et al. ..... 117/106
3,693,387 A * 9/1972 Blackburn ..... 72/41
5,201,118 A * 4/1993 MaParland ..... 29/890.031
5,292,237 A 3/1994 Orimo et al.
5,457,977 A * 10/1995 Wilson ..... 72/56
6,126,425 A * 10/2000 Fukui ..... 418/83

FOREIGN PATENT DOCUMENTS

JP 62-148067 * 2/1987 ..... 164/58.1
JP 05 118 288 A1 5/1993

* cited by examiner

*Primary Examiner*—Thomas Denion
*Assistant Examiner*—Theresa Trieu
(74) *Attorney, Agent, or Firm*—Sughrue Mion, PLLC

(57) ABSTRACT

In accordance with the invention, the vacuum pump cooling system includes tubes expanded along their entire length in bores through the vacuum pump body. The tubes can be made of stainless steel, and inserted into a vacuum pump body made of cast iron. This prevents the risk of corrosion of the vacuum pump body by a cooling liquid passing through the tubes to cool the vacuum pump body.

15 Claims, 3 Drawing Sheets

VACUUM PUMP COOLING SYSTEM, AND A METHOD OF MAKING IT

BACKGROUND OF THE INVENTION

1. Field of the Invention

The present invention relates to vacuum pumps, especially primary vacuum pumps used in the semiconductor industry to lower the pressure in process chambers from atmospheric pressure.

The above vacuum pumps must resist many kinds of attacks, resulting in particular from the fact that the gases pumped out of the process chamber are highly corrosive and impose the use of particular materials for making the body of the vacuum pump.

The temperature of the body of a vacuum pump must preferably be controlled, on the one hand to prevent binding due to thermal expansions, and on the other hand to maintain the pumped gases at appropriate temperatures to prevent them being converted into the form of solid deposits in the pump.

Also, vacuum pumps operate in a controlled environment of the white room type, in which cooling systems cannot employ a flow of air. It follows that the temperature of the pump body must be controlled by circulating a cooling liquid.

The temperature of a vacuum pump body in operation is relatively high, and there is therefore a high risk of corrosion of the walls of the cooling circuit of the pump by the cooling liquid, and a risk of deposition of material on the walls of the cooling circuit.

2. Description of the Prior Art

One current solution to the problem of cooling a vacuum pump is to use an anticorrosion coating in the cooling circuit. The anticorrosion coating, for example a coating of polytetrafluoroethylene, is deposited on the stationary parts of the pump body to isolate the cooling liquid, such as deionised water, from the materials of the body of the vacuum pump. A disadvantage is that an anticorrosion coating of this kind is generally made from a thermally insulative material, which reduces the thermal exchange and the cooling capacity of the circuit. Another disadvantage is the risk of local defects in the continuity of any coating obtained by depositing a material. As a result of this reliability and efficiency are not satisfactory.

It has also been proposed to attach to the body of the vacuum pump metal parts which at the same time conduct the cooling liquid, provide resistance to corrosion, and convey heat between the vacuum pump body and the cooling liquid. This solution increases the overall size of the pump, and increases the cost of manufacture of the vacuum pump.

The document JP 05 118 288 describes a vacuum pump in which each bearing and gear housing is cooled by a fluid flowing through a stainless steel tube cast into the housing. This solution has many disadvantages. First of all, the casting operation is always difficult because of the difficulty of placing and retaining the tube in the casting mould. Next, the embedded tube is so intimately bonded to the housing that it is practically impossible to change it afterwards. And most importantly, the metal constituting the housing body is generally a metal with a high melting point, and is therefore cast at a temperature at which the tube looses its anticorrosion properties. As a result, corrosion protection is insufficient.

Also known in the art is the expansion by rolling technique, which is mainly used to make a rigid mechanical connection between the end of a tube and a support plate. To achieve this, an expander tool is inserted into the interior of the end section of tube, and the tube is deformed radially beyond its elastic limit to take up the clearance between its outside diameter and a bore in the plate; the expander tool then applies further radial deformation and expands the tube to make the mechanical connection between the tube and the support plate.

SUMMARY OF THE INVENTION

The invention aims to design a new vacuum pump cooling system structure, and a method for making it, providing at the same time good thermal conduction between the cooling liquid and the vacuum pump body, further reducing the risks of corrosion by the cooling liquid, and reducing the cost of manufacture. The invention must enable the use of appropriate materials suitable at the same time for the cooling liquid and for the materials constituting the vacuum pump body, and prevent any overheating likely to degrade the anticorrosion properties of the materials employed.

The invention also aims to facilitate subsequent changing of the anticorrosion materials, if necessary, depending on the conditions of use.

The idea which is at the basis of the present invention consists of using the expansion technique by applying it in a novel manner to making an anticorrosion wall in a vacuum pump body cooling circuit.

To that end, the invention provides a vacuum pump cooling system including a cooling circuit in which a cooling liquid flows in the vacuum pump body and is isolated from the material constituting the vacuum pump body by at least one layer of anticorrosion material preventing corrosion of the vacuum pump body by the cooling liquid; said layer of anticorrosion material includes at least one tube of a material that is resistant to corrosion and a good thermal conductor and is expanded into a corresponding housing in the vacuum pump body.

In routine applications, the vacuum pump body is made of cast iron. The tube can then advantageously be made of stainless steel. The cooling liquid can be deionised water. The expansion is effected cold, and avoids degrading the stainless steel when the tube is assembled into the vacuum pump body, degradation which could happen if the tube were fitted by a heat treatment or by casting the cast iron around it.

As an alternative to this, with a cast iron vacuum pump body, tubes of a metal or light alloy such as copper, monel or inconel can be used. The expansion technique enables the use of these materials without degrading their anticorrosion properties.

In any event, a tube of a material that is not corroded by the cooling liquid is chosen. The expansion technique allows a wide choice of materials, and therefore effective matching to different cooling liquids and to different materials constituting the vacuum pump body.

In the case of a tube made of stainless steel, which is not very malleable, the interface between the tube and the vacuum pump body can advantageously be smooth.

In contrast, if the tube is made of a material that is more ductile, such as copper, the interface between the tube and the vacuum pump body can be rough. For example, a bore can be provided in the vacuum pump body whose surface state prior to the expansion step is rough.

The material forming the tube is preferably expanded throughout the length of the housing in the pump body that receives it.

The invention also provides a method of producing the above kind of vacuum pump cooling system, including a step of radially expanding the tube beyond its elastic limit in the corresponding housing of the vacuum pump body, by applying an appropriate pressure to the inside of the tube.

The appropriate pressure can be applied by an expandable sleeve fed with a hydraulic fluid under pressure.

Alternatively, the appropriate pressure can be applied by a mechanical expander tool.

Other objects, features and advantages of the present invention will emerge from the following description of particular embodiments, given with reference to the accompanying drawings.

DETAILED DESCRIPTION OF THE PREFERRED EMBODIMENTS

Figure 1:
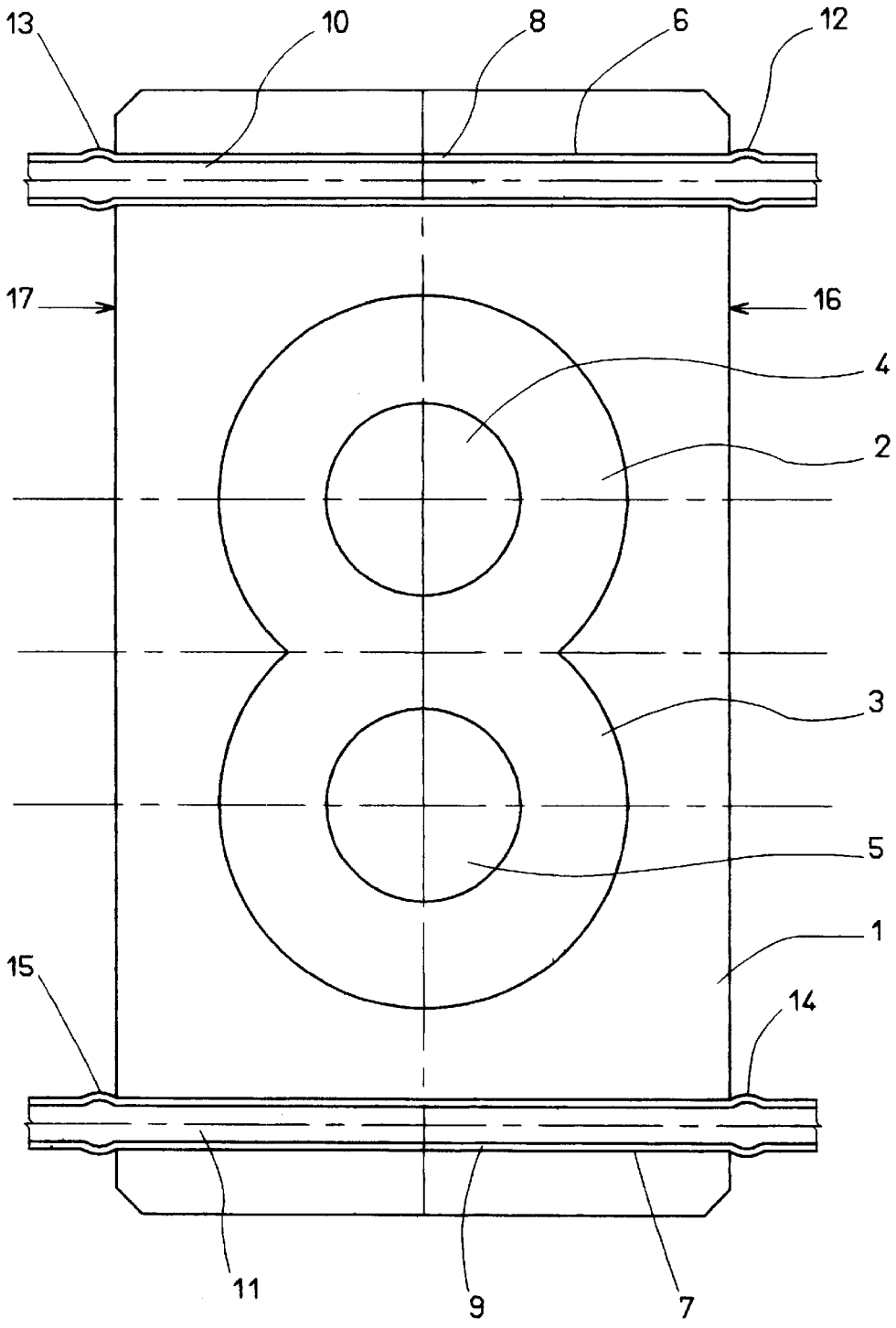
FIG. 1 shows diagrammatically, in section, a vacuum pump body with a cooling system in accordance with one embodiment of the present invention.

In the embodiment shown in FIG. 1, a vacuum pump comprises a vacuum pump body 1, made of cast iron, for example, in which are formed pumping chambers 2 and 3 receiving a rotor driven by a shaft, such as the shafts 4 and 5. The end parts of the vacuum pump body 1 can be formed of housings attached to the remainder of the body and containing roller bearings and gears for supporting and mechanically driving the shafts 4 and 5, with all these components immersed in oil. This is known in the art.

The temperature of the vacuum pump is controlled by a cooling circuit in which flows a cooling liquid which is isolated from the material constituting the vacuum pump body 1.

In accordance with the invention, bores are formed through the vacuum pump body 1, such as the bores 6 and 7, placed in appropriate areas for cooling the vacuum pump body 1, especially in the end parts of the vacuum pump body 1. Each bore 6 or 7 constitutes a housing into which is fitted a tube 8 or 9 of a material resisting corrosion by the cooling liquid that passes through the respective central bore 10 or 11 of the tube 8 or 9.

The tube 8 or 9 is expanded in the corresponding housing or bore 6 or 7.

In the embodiment shown in the figure, the tube 8 or 9 is a circular cylinder and passes through the vacuum pump body 1 along a substantially rectilinear path. This disposition enables assembly by deformation of the tube 8 or 9 by mechanical expansion.

The material of the tube 8 or 9 is preferably expanded over the whole length of the corresponding bore or housing 6 or 7 in the vacuum pump body 1. This optimises mechanical contact between the tube 8 or 9 and the vacuum pump body 1, and therefore optimises the transmission of heat between the cooling liquid and the vacuum pump body 1.

The material of the tube 8 or 9 is preferably deformed by radial expansion as far as the transition areas of the tube which project from either end of the corresponding bore or housing 6 or 7 in the vacuum pump body 1. In practise, this expansion produces end collars 12 to 15, i.e. areas of the tube of greater diameter, in the outlet areas of the tubes 8 and 9, starting from the end faces 16 and 17 of the vacuum pump body. This optimises mechanical contact and heat transmission, and prevents the risk of corrosion in the interstices between the vacuum pump body 1 and the tubes 8 and 9.

In a first embodiment, the vacuum tube body 1 is made of cast iron, and the tube 8 or 9 is made of stainless steel. The cooling liquid can then be deionised water, for example.

Alternatively, the vacuum pump body 1 can be made of cast iron, and the tube 8 or 9 can be made of a metal or alloy such as copper, monel or inconel, notably.

In all cases, the tube 8 or 9 is of a material that is not corroded by the cooling liquid.

In the embodiments in which the metal of the tube 8 or 9 is not very ductile, the interface between the tube 8 or 9 and the vacuum pump body 1 can advantageously be smooth. In other words, before inserting the tube 8 or 9 in the bore 6 or 7, a smooth surface is imparted to the bore 6 or 7, so that the interface will remain smooth after assembling the tube 8 or 9 into the vacuum pump body 1.

In contrast, in cases where the material of the tube 8 or 9 is ductile, it may be advantageous to provide a rough interface between the tube 8 or 9 and the vacuum pump body 1. This increases the surface area of contact and improves thermal exchange.

Figure 2:
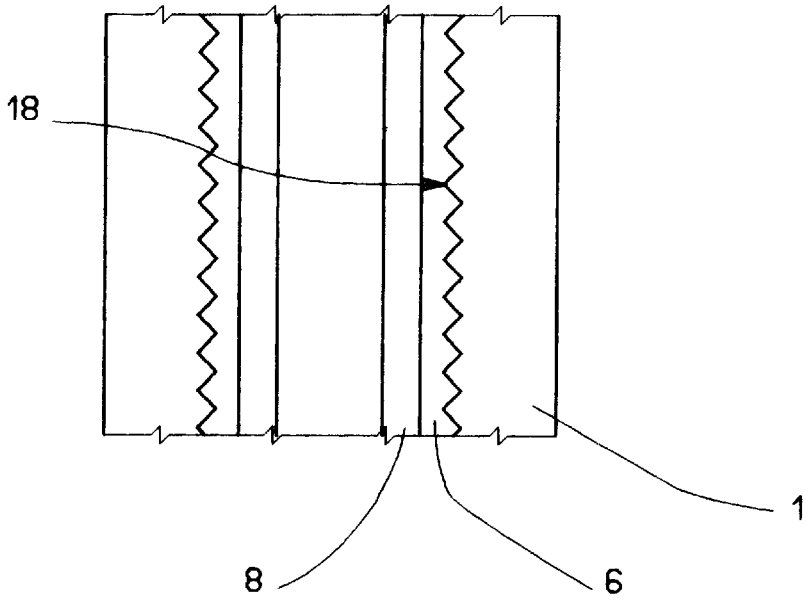
FIGS. 2 and 3 show two successive steps of expanding a tube into a vacuum pump body.
Figure 3:
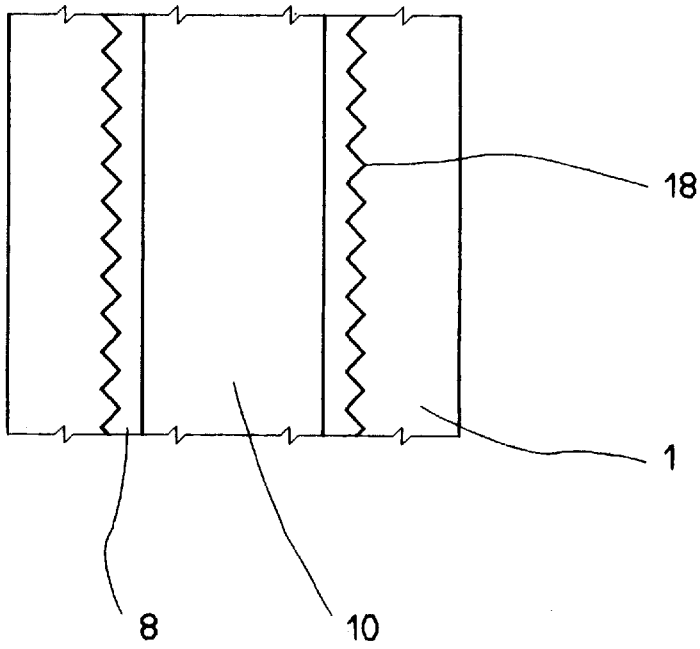

FIGS. 2 and 3 show the expansion operation. Before expansion, as shown in FIG. 2, the tube 8 has an outside diameter less than the diameter of the bore 6 in the vacuum pump body 1, and the surface state of the peripheral face 18 of the bore 6 is appropriate to the metal forming the tube 8.

After expansion, as shown in FIG. 3, the outside diameter of the tube 8 has been increased by the pressure applied to the inside of the tube 8 by the expander tool inserted into the central bore 10 of the tube 8, and the outside face of the tube 8 is pressed against the peripheral face 18 of the bore in the vacuum pump body 1.

Figure 4:
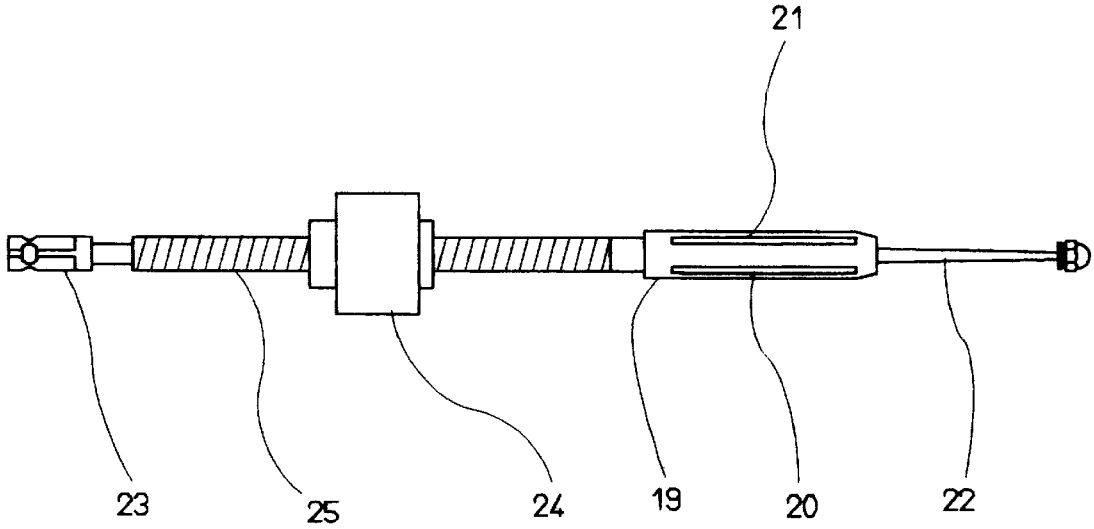
FIG. 4 shows one mechanical expander tool structure.

By way of illustration, there is shown diagrammatically in FIG. 4 a mechanical expander tool that can be used to implement the present invention. The essential part of the expander tool is a sleeve 19 in which are distributed a plurality of peripheral rollers, such as the rollers 20 and 21, which are coaxial with the main axis of the tool, and rotatably mounted in the sleeve 19 projecting partly from its periphery. The rollers 20 and 21 are moved radially outwards by a conical axial rod 22 which can be moved axially inside the sleeve 19 by manoeuvring it from the posterior end 23 of the tool. A bearing ring 24 can be moved relative to the sleeve 19 by screwing it onto a threaded part 25 of the tool.

In use, the tool is inserted into the bore of a tube like the tube 8, and is driven in axial rotation. During this rotation, by simultaneous traction on the conical axial rod 22, the rollers 20 and 21 are moved apart in the radial direction and cause the material of the tube 8 to flow progressively, expanding it by deforming it beyond the capacity of the material for elastic deformation.

Clearly the tool constituted in this way, as shown in FIG. 4, can expand a section of limited length of a tube. Thus, to effect the expansion over the whole of the length of a tube 8, as shown in FIG. 1, the appropriate pressure is applied to the inside of the tube 8 by the expander tool in successive and longitudinally distributed partial sections of the tube 8 until the tube 8 has been deformed over its entire length.

The expansion described above is mechanical expansion. Hydraulic expansion can be used instead. In this case, the appropriate pressure is applied by an expandable sleeve fed with a hydraulic fluid under pressure.

The invention makes an effective cold mechanical connection between the inert material tubes and the interior of a vacuum pump body 1, without degrading the anticorrosion properties of the material of the tube, and ensuring excellent thermal conduction between the tube and the vacuum pump body 1.

The present invention is not limited to the embodiments explicitly described, and includes variations and generalisations thereof that will be evident to the skilled person.

What is claimed is:

1. A vacuum pump cooling system, including a cooling circuit in which a cooling liquid flows in the vacuum pump body and is isolated from a material constituting the vacuum pump body by at least one layer of anticorrosion material preventing corrosion of the vacuum pump body by the cooling liquid, characterized in that said layer of anticorrosion material includes at least one tube of a material that is resistant to corrosion and a good thermal conductor and is expanded into a corresponding housing in the vacuum pump body;

wherein the vacuum pump body is made of cast iron, and the tube is made of stainless steel; and wherein the cooling liquid is deionised water.

2. A vacuum pump cooling system, including a cooling circuit in which a cooling liquid flows in the vacuum pump body and is isolated from a material constituting the vacuum pump body by at least one layer of anticorrosion material preventing corrosion of the vacuum pump body by the cooling liquid, characterized in that said layer of anticorrosion material includes at least one tube of a material that is resistant to corrosion and a good thermal conductor and is expanded into a corresponding housing in the vacuum pump body;

wherein the tube is a circular cylinder and passes through the vacuum pump body along a substantially rectilinear path;

wherein the material forming the tube is expanded over the whole of the length of said corresponding housing of the vacuum pump body; and wherein the material forming the tube is deformed by radial expansion as far as transition areas of the tube that project from each end of said corresponding housing of the vacuum pump body, thereby forming end collars.

3. A method of producing a vacuum pump cooling system, said vacuum cooling system including a cooling circuit in which a cooling liquid flows in the vacuum pump body and is isolated from a material constituting the vacuum pump body by at least one layer of anticorrosion material preventing corrosion of the vacuum pump body by the cooling liquid, wherein the method includes a step of radially expanding the tube beyond its elastic limit in the corresponding housing of the vacuum pump body by applying an appropriate pressure to the inside of the tube.

4. A method according to claim 3, wherein the appropriate pressure is applied by an expandable sleeve fed with a hydraulic fluid under pressure.

5. A method according to claim 3, wherein the appropriate pressure is applied by a mechanical expander tool.

6. A method according to claim 5, wherein the appropriate pressure is applied by the expander tool in a succession of longitudinally distributed partial sections of tube until the tube has been deformed over its entire length.

7. A vacuum pump cooling system, comprising:

a vacuum pump body defining a pumping chamber and including a bore formed in the vacuum pump body; and a cooling circuit in which a cooling liquid flows in the bore and is isolated from an inside wall of the bore by at least one layer of anticorrosion material so as to prevent corrosion of the vacuum pump body by the cooling liquid;

wherein the layer of anticorrosion material is in the form of a tube that conducts thermal energy, and an outer wall of the tube is coupled to the inside wall of the bore by inserting the tube into the bore and radially expanding the tube.

8. A cooling system according to claim 7, wherein the vacuum pump body is made of cast iron and the tube is made of stainless steel.

9. A cooling system according to claim 8, wherein the interface between the tube and the vacuum pump body is smooth.

10. A cooling system according to claim 7, wherein the vacuum pump body is made of cast iron, and the tube is made of a metal or alloy.

11. The cooling system according to claim 10, wherein the tube is made of copper monel or inconel.

12. A cooling system according to claim 7, wherein the tube is made of a material that cannot be corroded by the cooling liquid.

13. A cooling system according to claim 7, wherein the material forming the tube is ductile, and an interface between the tube and the vacuum pump is rough.

14. A cooling system according to claim 7, wherein the tube is a circular cylinder and passes through the vacuum pump along a substantially rectilinear path.

15. The vacuum pump cooling system according to claim 7, wherein the tube is further expanded at both ends of the bore and outside the bore so that the tube has an end collar at each end of the bore.

* * * * *